US010935012B2

(12) United States Patent
Flemmer et al.

(10) Patent No.: US 10,935,012 B2
(45) Date of Patent: Mar. 2, 2021

(54) PUMPING STATION FOR A PIPELINE AND METHOD FOR STARTING A COMBUSTION ENGINE IN A PUMPING STATION

(71) Applicant: VOITH PATENT GMBH, Heidenheim (DE)

(72) Inventors: Daniel Flemmer, Ellrichshausen (DE); Bert Brahmer, Bruchsal (DE)

(73) Assignee: Voith Patent GmbH, Heidenheim (DE)

( * ) Notice: Subject to any disclaimer, the term of this patent is extended or adjusted under 35 U.S.C. 154(b) by 72 days.

(21) Appl. No.: 16/327,941

(22) PCT Filed: Jul. 24, 2017

(86) PCT No.: PCT/EP2017/068610
§ 371 (c)(1),
(2) Date: Feb. 25, 2019

(87) PCT Pub. No.: WO2018/036730
PCT Pub. Date: Mar. 1, 2018

(65) Prior Publication Data

US 2019/0186477 A1 Jun. 20, 2019

(30) Foreign Application Priority Data

Aug. 23, 2016 (DE) ..... 10 2016 215 758.2
Sep. 20, 2016 (DE) ..... 10 2016 217 959.4

(51) Int. Cl.
*F04B 17/05* (2006.01)
*F04B 23/00* (2006.01)
(Continued)

(52) U.S. Cl.
CPC ..... *F04B 17/05* (2013.01); *F02N 7/06* (2013.01); *F02N 15/022* (2013.01); *F04B 23/00* (2013.01)

(58) Field of Classification Search
CPC ..... F04B 17/05; F04B 23/00; F02N 15/022; F02N 7/06
See application file for complete search history.

(56) References Cited

U.S. PATENT DOCUMENTS 5,507,144 A * 4/1996 Gray, Jr. ..... F15B 1/02 60/327
5,660,198 A 8/1997 McClaran
(Continued)

FOREIGN PATENT DOCUMENTS

DE 2340386 A1 2/1975
DE 10025640 A1 12/2000
(Continued)

*Primary Examiner* — Thomas E Lazo
(74) *Attorney, Agent, or Firm* — Laurence A. Greenberg; Werner H. Stemer; Ralph E. Locher

(57) ABSTRACT

A pumping station for a pipeline, in particular an oil or gas pipeline, has a feed pump for delivering a fluid through the pipeline and a combustion engine for driving the feed pump. A hydrostatic system has a hydraulic motor for driving the combustion engine, in order to accelerate same to start-up. The hydraulic system also has a hydraulic pressure accumulator of limited volume which can be filled with a pressurized hydraulic medium to be admitted to the first hydraulic motor, thereby powering the latter. A pressure differential in the hydrostatic system prevailing over the hydraulic motor is variably adjustable, in order to accelerate the combustion engine to a predefined firing speed.

28 Claims, 2 Drawing Sheets

(51) Int. Cl.
*F02N 7/06* (2006.01)
*F02N 15/02* (2006.01)

(56) References Cited

U.S. PATENT DOCUMENTS

| | | | | |
|---|---|---|---|---|
| 6,363,721 | B1 | 4/2002 | Prenninger et al. | |
| 6,615,786 | B2 | 9/2003 | Mori et al. | |
| 8,479,869 | B2 * | 7/2013 | Knapp | E02F 9/2217 180/305 |
| 8,585,524 | B2 * | 11/2013 | Mueller | B60W 10/04 475/72 |
| 9,447,874 | B2 | 9/2016 | Meier et al. | |
| 10,059,184 | B2 | 8/2018 | Roehr et al. | |
| 10,288,094 | B2 * | 5/2019 | Spielvogel | F02N 7/06 |
| 2005/0196298 | A1 * | 9/2005 | Manning | F04B 35/04 417/364 |
| 2010/0077998 | A1 | 4/2010 | Chapman et al. | |
| 2013/0133853 | A1 * | 5/2013 | Stroganov | F15B 1/024 165/4 |
| 2015/0052889 | A1 * | 2/2015 | Krittian | F03C 1/26 60/596 |
| 2017/0234338 | A1 | 8/2017 | Spielvogel et al. | |

FOREIGN PATENT DOCUMENTS

| | | | |
|---|---|---|---|
| DE | 69615350 | T2 | 4/2002 |
| DE | 10220877 | A1 | 12/2002 |
| DE | 102006026829 | A1 | 12/2007 |
| DE | 202008008045 | U1 | 12/2009 |
| DE | 102011105006 | A1 | 10/2012 |
| DE | 102014215567 | A1 | 2/2016 |
| EP | 2891791 | A1 | 7/2015 |
| ES | 1072269 | U | 6/2010 |
| GB | 808745 | A | 2/1959 |
| RU | 2035614 | C1 | 5/1995 |

* cited by examiner

PUMPING STATION FOR A PIPELINE AND METHOD FOR STARTING A COMBUSTION ENGINE IN A PUMPING STATION

BACKGROUND OF THE INVENTION

Field of the Invention

The present invention relates to a pumping station for a pipeline, in particular an oil or gas pipeline. The pumping station has at least one feed pump for delivering a fluid through the pipeline; at least one combustion engine, which is or can be drive-connected to at least the one feed pump, in order to drive at least the one feed pump; and a hydrostatic system, which comprises at least one first hydraulic motor, which is or can be drive-connected to at least one combustion engine, in order to accelerate at least the one combustion engine to start-up by driving it. A hydraulic pressure accumulator of limited volume is provided in the hydrostatic system which can be filled with a pressurized hydraulic medium, which can be admitted to the first hydraulic motor, thereby powering the latter. The invention also pertains to a method for starting at least one combustion engine in such a pumping station. Pumping station includes compressor stations.

In pumping stations for oil or gas pipelines, combustion engines, for example large gas engines, are used to drive one or more feed pumps for delivering the medium—oil or gas—through the pipeline. Such gas engines have a power output of 1800 to 11000 hp, for example, and a starting torque of 32000 Nm at 4000 hp, for example. The firing speed may then be 65 rpm, for example, and is to be maintained for 30 seconds.

Conventionally, the medium delivered through the pipeline, in particular gas, is used for starting the combustion engine. For environmental reasons this is no longer felt to be desirable.

Alternative starting devices for combustion engines are disclosed in RU 2 035 614 C1 and ES 1 072 269 U.

The use of a hydrostatic system for starting combustion engines is also known. Here a hydraulic pressure accumulator is filled by means of a filling pump. The hydraulic medium contained in the hydraulic pressure accumulator, which may be embodied as a bladder accumulator, a piston accumulator or a spring-type accumulator, is then switched, electrically or by manual actuation of a valve, to a hydraulic motor, which runs the combustion engine up to an undefined speed, in order to fire the latter. In order to be able to establish a flow of power between the hydraulic motor and the crankshaft of the combustion engine, a gearing between the hydraulic motor and the combustion engine must be engaged. There are two known solutions to this, namely engagement by auxiliary power, for example electrical, hydraulic or pneumatic shifting of a gear wheel of the hydraulic motor into drive connection with the combustion engine, or engagement by exploiting the effect of inertia, the gear wheel of the hydraulic motor being arranged on a spiral spline and pre-engaged by the rotation of the hydraulic motor.

Starting the combustion engine, that is to say running up the crankshaft of the combustion engine by means of the hydraulic motor, has hitherto been done through uncontrolled transmission of the pressure prevailing in the pressure accumulator to the hydraulic motor by means of the hydraulic medium, so that the combustion engine is fired at an undefined speed. In doing this, a speed level is generally reached which is higher than necessary. This means that although the combustion engine can be reliably fired, the energy consumption from the hydraulic pressure accumulator is high, so that relatively large and therefore expensive hydraulic accumulators have to be provided.

SUMMARY OF THE INVENTION

The object of the present invention is to specify a pumping station for a pipeline of the type described above, which manages with a smaller, more cost-effective hydraulic pressure accumulator. It is furthermore intended to specify a method for starting a corresponding combustion engine in a pumping station which allows the use of the comparatively smaller hydraulic pressure accumulator.

The object of the invention is achieved by a pumping station as claimed and by a method as claimed. Advantageous and particularly suitable embodiments of the invention are specified in the dependent claims.

A pumping station according to the invention for a pipeline, in particular for an oil or gas pipeline, comprises at least one feed pump for delivering a fluid, in particular oil or gas, through the pipeline. At least one combustion engine is furthermore provided, which is or can be drive-connected to at least the one feed pump in order to drive at least the one feed pump.

According to the invention a hydrostatic system is provided, which comprises at least a first hydraulic motor, which is or can be drive-connected to at least one combustion engine, in order to accelerate at least the one combustion engine to start-up by driving the crankshaft of the combustion engine, for example. This means that the hydraulic motor, as already outlined, runs the combustion engine up, in particular from standstill. Should synchronization between the output shaft of the hydraulic motor and the crankshaft of the combustion engine be necessary, resort may be made to the solutions described above. Alternatively, a synchronizer clutch or non-synchronized coupling may be provided between the hydraulic motor and the combustion engine. In particular, at least one transmission step is provided between the hydraulic motor and the combustion engine, in order, for example, to step the speed of the combustion engine down to the speed of the hydraulic motor.

In the hydrostatic system, a hydraulic pressure accumulator of limited volume is provided, which can be filled with a pressurized hydraulic medium, which hydraulic medium is admitted to the first hydraulic motor, thereby powering the latter accordingly.

According to the invention the pressure differential in the hydraulic system prevailing over at least the one first hydraulic motor is variably adjustable, in order to accelerate the combustion engine to a predefined firing speed.

According to the invention, therefore, uncontrolled revving of the combustion engine to a relatively high speed level before it is fired does not occur. Rather, the speed of the combustion engine, in particular its crankshaft, is purposely adjusted to a comparatively lower speed which is just sufficient to ensure reliable firing of the combustion engine.

The solution according to the invention therefore serves to avoid unnecessary consumption of energy, that is to say of pressurized hydraulic medium from at least the one pressure accumulator.

For specific, variable adjustment of the pressure differential prevailing on the first hydraulic motor, according to one embodiment of the invention an adjustable throttle valve is provided in the hydrostatic system upstream or downstream of the first hydraulic motor in the direction of flow of the hydraulic medium.

In addition or as an alternative to this, an additional hydraulic motor, in which the pressure of the hydraulic medium is reduced, may be provided in the hydrostatic system, so that a lower pressure level or a lower pressure differential is available for the first hydraulic motor. The additional hydraulic motor may be connected to the pressure accumulator in series with the first hydraulic motor, in terms of the flow of hydraulic medium passing through it. Some other positioning in the hydrostatic system is also possible, however, as will emerge from the following. The adjustable throttle valve may then also be positioned in series with the additional hydraulic motor.

In this embodiment with the additional hydraulic motor a hydraulic pump driven by the additional hydraulic motor is furthermore provided, which feeds the hydraulic medium, in particular from a hydraulic medium reservoir, into the first hydraulic motor or into a hydraulic medium flow, which is delivered to the first hydraulic motor from the pressure accumulator. In the first aforementioned arrangement, therefore, the hydraulic medium from the pressure accumulator may be led only to the additional hydraulic motor and the hydraulic medium delivered by the hydraulic pump is then fed to the first hydraulic motor, so that this is driven in order to accelerate the combustion engine. In the second embodiment the additional hydraulic motor may be connected to the pressure accumulator in series or in parallel with the first hydraulic motor, relative to a through-flow of the hydraulic medium from the pressure accumulator.

The additional hydraulic motor may be embodied as a variable-capacity motor, so that its power input can be regulated, particularly in order to be able to dispense with an adjustable throttle valve for reducing the drive power of the first hydraulic motor. In addition or alternatively, the hydraulic pump may be correspondingly embodied as a variable-capacity pump, in order to adjust its power input.

The first hydraulic motor is embodied, in particular, as a constant-capacity motor.

At least one boost pump is preferably provided in the hydrostatic system, which feeds hydraulic medium from a hydraulic medium reservoir, in particular from the hydraulic medium reservoir on which the hydraulic pump also draws, into the pressure accumulator, wherein the boost pump in particular comprises an electric drive motor. Other drives, for example a combustion engine, are also possible as drive, however.

The additional hydraulic motor and/or the hydraulic pump is/are advantageously embodied as an axial piston machine, for example as a bent-axis machine, swash-plate machine or wobble-plate machine. It is advantageously possible here for the power input and the displacement to be adjusted by controlling the swivel angle.

The pressure accumulator is preferably embodied as an accumulator with gas tensioning device, in particular as a bladder accumulator or diaphragm accumulator. An additional gas reservoir advantageously has a gas-carrying connection to a gas side of the pressure accumulator, in order to boost the gas spring of the pressure accumulator. For example, with a constant pressure level and constant maximum accumulator pressure through the connection of an additional gas reservoir, which may be filled with nitrogen, for example, the maximum absorbable quantity of hydraulic medium can be doubled, particularly if the gas reservoir has at least the same volumetric capacity as the pressure accumulator.

At least one sensor, which together with a control device, which is wirelessly connected or wired to at least the one sensor, indirectly determines the speed of the combustion engine as a function of a state variable in the hydrostatic system, is preferably arranged in the hydrostatic system. For example, at least the one sensor is arranged in the area of the additional hydraulic motor or a hydraulic motor-pump unit, which comprises the additional hydraulic motor and the hydraulic pump, and/or in the area of the adjustable throttle valve. It is also possible, to determine the hydraulic medium flow though the first hydraulic motor and/or its power input by means of the sensor. Thus, for example, the speed of the additional hydraulic motor and/or the hydraulic pump can be used to indirectly determine the speed of the combustion engine, or the hydraulic medium flow at a predefined point in the hydrostatic system. It is also possible, for example, to use the position of the adjustable throttle valve for this purpose or, for example, the current swivel angle of the additional hydraulic motor and/or the hydraulic pump. This list is not exhaustive, the use of other variables also being feasible.

It is obviously also possible to determine or to measure the speed of the combustion engine directly from other state variables outside the hydrostatic system.

As a rule, at least the one combustion engine is positioned in an explosion safety zone, that is to say the components provided there comprise additional devices designed to prevent an explosion. This implies an increased financial and technical outlay for all components located in the explosion safety zone. For this reason, therefore, at least one or more or all of the following devices are positioned, spatially separated from at least the one combustion engine and at least the one feed pump and in particular at least the one first hydraulic motor, outside this explosion safety zone:

- the hydraulic pressure accumulator, in particular together with the gas reservoir
- at least the one boost pump, in particular together with its electric drive motor
- the hydraulic medium reservoir
- the additional hydraulic motor
- the adjustable throttle valve
- at least the one sensor
- the hydraulic pump
- the control device.

In particular, all the necessary sensors are arranged outside the explosion safety zone and the connection from outside the explosion safety zone into the explosion safety zone is made only via hydraulic lines and where necessary any electrical control lines.

According to one embodiment of the invention the first hydraulic motor may be used for starting a plurality of combustion engines or multiple "first" hydraulic motors are provided, which are each used for starting a combustion engine or multiple combustion engines. All of these corresponding hydraulic motors are advantageously incorporated in the same hydrostatic system and can be actuated simultaneously or in succession. Here the same adjustable throttle valve and/or the same hydraulic motor-pump unit can be used for specifically adjusting the pressure differential via the respective hydraulic motor, in order to consume as little hydraulic medium as possible from the pressure accumulator.

At least the one combustion engine may comprise at least one turbocharger, to which a drive is assigned in order to accelerate the turbocharger on starting the combustion engine or before starting the combustion engine, that is to say before running the combustion engine up to firing speed.

The drive may be embodied as a hydraulic motor, for example, wherein the hydraulic motor is fed with hydraulic medium from the hydraulic pressure accumulator and/or preferably, in order to conserve its capacity, from the boost pump.

In addition or alternatively, an electric motor may also be provided as drive for the turbocharger.

A method according to the invention for starting at least one combustion engine in a pumping station, as outlined, consists in accelerating at least the one combustion engine by means of at least the one first hydraulic motor and firing at least the one combustion engine after accelerating it, wherein the speed of the combustion engine is adjusted to a predefined firing speed before firing, using the first hydraulic motor for variable adjustment of the pressure differential occurring in the hydrostatic system as hydraulic medium flows through it.

BRIEF DESCRIPTION OF THE SEVERAL VIEWS OF THE DRAWING

The invention will be described below by way of example, referring to exemplary embodiments and the figures, of which.

DESCRIPTION OF THE INVENTION

Figure 1:
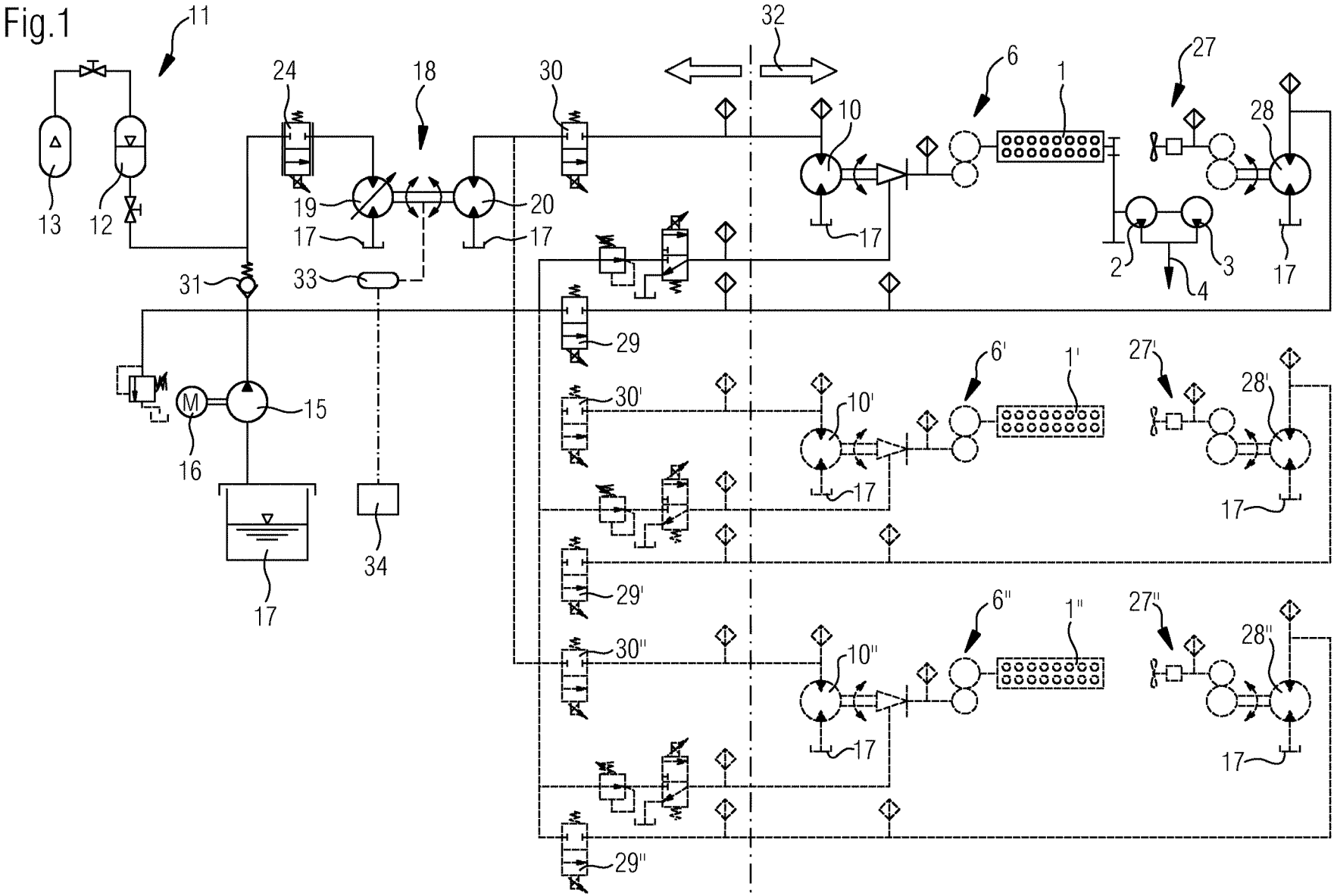
FIG. 1 shows a first exemplary embodiment of a pumping station according to the invention.

FIG. 1 represents a pumping station for a pipeline, having a combustion engine 1, which drives feed pumps 2, 3 in a pipeline 4. Dashed lines show that further combustion engines 1' and 1" could also be provided, which drive corresponding feed pumps (not shown) or other assemblies. Instead of the first hydraulic motor 10, multiple hydraulic motors may also be provided, which interact in order to accelerate a combustion engine to a predefined firing speed.

For starting each of the corresponding combustion engines 1, 1', 1" a first hydraulic motor 10 (or 10', 10") is provided, which can be coupled to the corresponding combustion engine 1, 1', 1" via a suitable clutch 6. The clutch 6 may be actuated or activated by the pressure of the hydraulic medium, for example. The clutch 6 serves to provide a releasable mechanical connection to the combustion engine. Such clutches are also referred to as meshing drives. The hydraulic motor serves to accelerate the combustion engine 1, 1', 1" to a predefined firing speed.

The respective combustion engine 1, 1', 1" comprises a turbocharger 27, 27', 27", which is brought to a required speed before ever the combustion engine 1, 1', 1" is started, that is to say by pressurized hydraulic medium from a boost pump 15, which here is driven by an electric motor 16 and fed from a hydraulic medium reservoir 17. For this purpose, a hydraulic motor 28, 28', 28", which is driven by the pressurized hydraulic medium, is or can be connected to the respective turbocharger 27, 27', 27". A corresponding valve, in particular a directional control valve 29, 29', 29", is provided for connecting the pressurized hydraulic medium to the hydraulic motor 28, 28', 28".

The pressure admitted to the first hydraulic motor 10, 10', 10" may likewise be switched on and off by means of a valve 30, 30', 30", the necessary pressurized hydraulic medium being supplied by the hydraulic pump 20 of the motor-pump unit 18. The hydraulic pump 20 likewise delivers from the hydraulic medium reservoir 17 and is driven by an additional hydraulic motor 19, which is fed with pressurized hydraulic medium from the pressure source 11 via an adjustable throttle valve 24, which in particular is likewise embodied as a directional control valve. The pressure source 11 comprises a pressure accumulator 12, to the gas side of which a gas reservoir 13 is connected in order to boost the so-called gas spring.

The pressure accumulator 12 is filled by means of the boost pump 15, in particular via a check valve 31.

In the hydrostatic system, most of which is positioned outside the explosion zone 32 (see the dashed dividing line), at least one sensor 33 is provided, which together with a control device 34 indirectly determines the speed of the respective combustion engine 1, 1', 1". The sensor 33 serves, for example, to determine the speed of the motor-pump unit 18.

Using the motor-pump unit 18, the additional hydraulic motor 19 being embodied as a variable-capacity motor, for example, it is possible to precisely adjust the power input and hence the drive power of the first hydraulic motor 10 or the corresponding hydraulic motors 10', 10", in order that the combustion engine 1 or the corresponding combustion engines 1', 1" are only accelerated up to the precise firing speed necessary.

Figure 2:
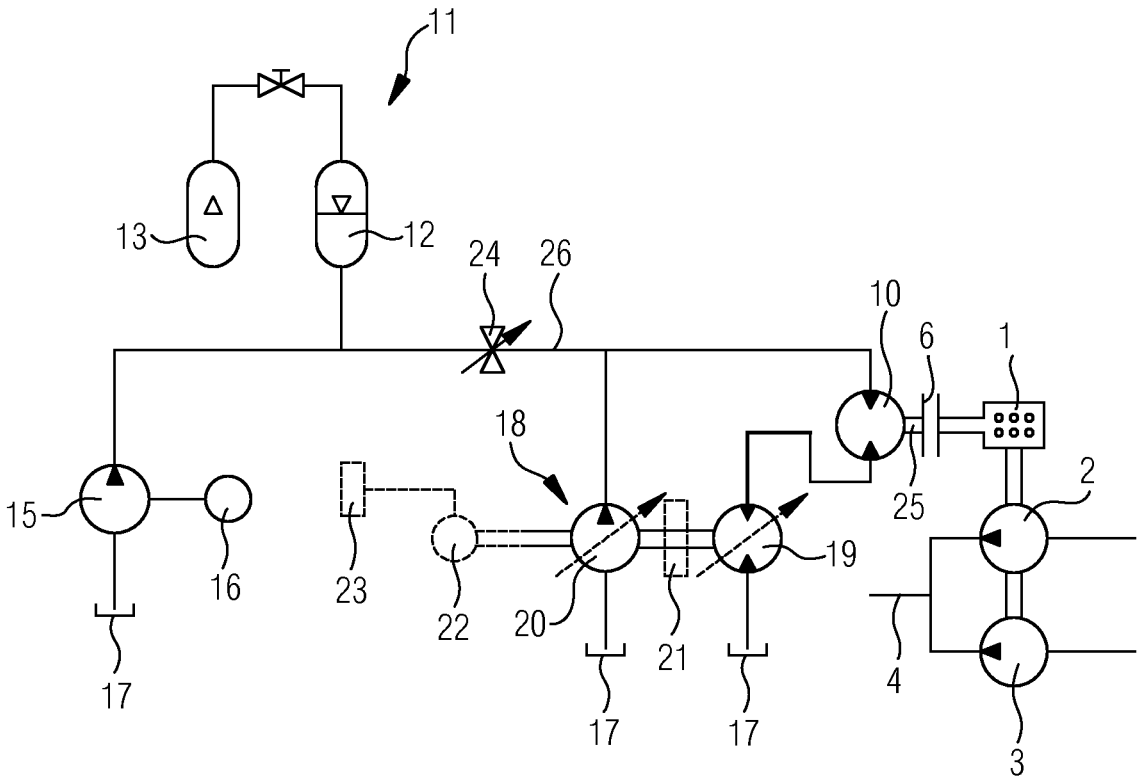
FIG. 2 shows a different way of incorporating the hydraulic motor-pump unit compared to FIG. 1.

The embodiment according to FIG. 2 largely corresponds to that in FIG. 1, but here the motor-pump unit 18 is incorporated differently into the hydrostatic system. Corresponding reference numerals relate to corresponding components.

It is indicated in FIG. 2 that the additional hydraulic motor 19 and/or the hydraulic pump 20 could be embodied as a variable-capacity motor or variable-capacity pump. It is furthermore indicated that besides the rigid coupling, a variable-speed transmission 21 might be provided, in particular by means of a common shaft, between the additional hydraulic motor 19 and the hydraulic pump 20, together with an electrical generator or motor generator 22 and an electrical accumulator 23, in order to recover electrical energy from the hydrostatic system or reversibly return it to the system. These measures are can also be applied in the case of the embodiment according to FIG. 1.

As also in the embodiment according to FIG. 1, a clutch 6, which for example connects the output shaft 25 of the first hydraulic motor 10 to a crankshaft of the combustion engine 1 either directly or preferably by way of at least one transmission step or a meshing drive, may be provided between the combustion engine 1 and the first hydraulic motor 10.

In the embodiment according to FIG. 2, also, operating the motor-pump unit 18 reduces the pressure supplied by the hydraulic pressure source 11, so that the first hydraulic motor 10 delivers a correspondingly lower drive power to its output shaft 25. At the same time, driving the hydraulic pump 20 increases the volumetric flow through the first hydraulic motor 10, so that a sensitive control can be achieved and energy can be drawn from the hydrostatic system only to the desired limited extent.

The invention claimed is:

1. A pumping station for a pipeline, the pumping station comprising:

at least one feed pump for delivering a fluid through the pipeline;

at least one combustion engine configured for driving said at least the one feed pump;

a hydrostatic system having a first hydraulic motor configured to drive said at least one combustion engine and to accelerate said at least one combustion engine to start-up;

said hydrostatic system having a hydraulic pressure accumulator of limited volume to be filled with a pressurized hydraulic medium, which can be fed to said first hydraulic motor, to thereby power said first hydraulic motor; and wherein a pressure differential in the hydrostatic system prevailing over said first hydraulic motor is variably adjustable, in order to accelerate said combustion engine to a predefined firing speed; and an adjustable throttle valve in said hydrostatic system upstream or downstream of the first hydraulic motor in a flow direction of the hydraulic medium, for variable adjustment of the pressure differential prevailing over said first hydraulic motor.

2. A method for starting at least one combustion engine in a pumping station according to claim 1, the method comprising the following steps:

accelerating the at least one combustion engine by at least one first hydraulic motor and subsequently firing the at least one combustion engine;

adjusting a speed of the combustion engine to a predefined firing speed before firing, using the first hydraulic motor for variable adjustment of a pressure differential occurring in a hydrostatic system as hydraulic medium flows therethrough.

3. The method according to claim 2, which comprises determining a state variable in the hydrostatic system by at least one sensor and a control device, and calculating or determining therefrom an actual speed of the combustion engine.

4. The method according to claim 3, which comprises registering as the state variable at least one variable selected from the group consisting of:

a hydraulic medium flow through the first hydraulic motor and/or through an additional hydraulic motor;

a speed of the additional hydraulic motor and/or the hydraulic pump;

the hydraulic medium flow through an adjustable throttle valve;

a position of the adjustable throttle valve and/or, with the proviso that the additional hydraulic motor is a variable-capacity motor, a setting of the variable-capacity motor and/or of an actuator of the adjustable throttle valve and/or of the additional hydraulic motor connected thereto; and where the hydraulic pump is a variable-capacity pump, the position of the hydraulic pump and/or of an actuator connected thereto.

5. The method according to claim 4, which comprises accelerating the turbocharger of the combustion engine by way of the drive before firing of the combustion engine.

6. The method according to claim 2, which comprises accelerating the turbocharger of the combustion engine by way of the drive before firing of the combustion engine.

7. The pumping station according to claim 1, which comprises an additional hydraulic motor in said hydrostatic system connected to receive hydraulic medium from said the pressure accumulator, and a hydraulic pump powered by said additional hydraulic motor configured to feed hydraulic medium into said first hydraulic motor.

8. The pumping station according to claim 7, which comprises an hydraulic medium reservoir containing hydraulic medium, and wherein said hydraulic pump is configured to feed the hydraulic medium from said hydraulic medium reservoir into said first hydraulic motor.

9. The pumping station according to claim 7, wherein said additional hydraulic motor is a variable-capacity motor and/or said hydraulic pump is a variable-capacity pump.

10. The pumping station according to claim 7, further comprising:

an additional hydraulic motor in said hydrostatic system connected to receive hydraulic medium from said the pressure accumulator, and a hydraulic pump powered by said additional hydraulic motor configured to feed hydraulic medium into said first hydraulic motor, further comprising a hydraulic medium reservoir containing hydraulic medium, and wherein said hydraulic pump is configured to feed the hydraulic medium from said hydraulic medium reservoir into said first hydraulic motor;

at least one booster pump in said hydrostatic system, for feeding hydraulic medium from a hydraulic medium reservoir into said pressure accumulator; and said pressure accumulator being an accumulator with a gas tensioning device, and an additional pressurized gas reservoir having a gas-carrying connection to a gas side of said pressure accumulator.

11. The pumping station according to claim 10, which comprises a control device and at least one sensor disposed in said hydrostatic system and connected to said at least the one sensor for determining a speed of said combustion engine indirectly as a function of sensor measured values.

12. The pumping station according to claim 11, wherein said combustion engine, said at least one feed pump and said first hydraulic motor are arranged inside an explosion safety zone, and at least one or more or all of the following devices are positioned, spatially separated, outside said explosion safety zone:

said hydraulic pressure accumulator;

at least one booster pump;

said hydraulic medium reservoir;

an additional hydraulic motor;

an adjustable throttle valve;

at least one sensor;

a gas reservoir; and a control device.

13. The pumping station according to claim 12, wherein said at least one booster pump together with its electric drive motor and said additional hydraulic motor together with the hydraulic pump are disposed outside said explosion safety zone.

14. The pumping station according to claim 12, wherein said combustion engine comprises at least one turbocharger, to which a drive is assigned in order to accelerate said turbocharger on or before a start of said combustion engine.

15. The pumping station according to claim 1, which comprises at least one booster pump in said hydrostatic system, for feeding hydraulic medium from a hydraulic medium reservoir into said pressure accumulator.

16. The pumping station according to claim 15, wherein said booster pump is an electric drive motor.

17. The pumping station according to claim 1, wherein said pressure accumulator is an accumulator with a gas tensioning device, and an additional pressurized gas reservoir has a gas-carrying connection to a gas side of said pressure accumulator.

18. The pumping station according to claim 1, which comprises a control device and at least one sensor disposed in said hydrostatic system and connected to said at least the one sensor for determining a speed of said combustion engine indirectly as a function of sensor measured values.

19. The pumping station according to claim 1, wherein said combustion engine, said at least one feed pump and said first hydraulic motor are arranged inside an explosion safety zone, and at least one or more or all of the following devices are positioned, spatially separated, outside said explosion safety zone:

said hydraulic pressure accumulator;

at least one booster pump;

said hydraulic medium reservoir;

an additional hydraulic motor;

an adjustable throttle valve;

at least one sensor;

a gas reservoir; and a control device.

20. The pumping station according to claim 19, wherein said at least one booster pump together with its electric drive motor and said additional hydraulic motor together with the hydraulic pump are disposed outside said explosion safety zone.

21. The pumping station according to claim 1, wherein said at least one combustion engine is one of a plurality of combustion engines for driving a plurality of feed pumps or other assemblies, wherein said combustion engines can be started by being drive-connected to said first hydraulic motor or can be drive-connected to a plurality of corresponding hydraulic motors, wherein all corresponding hydraulic motors can be powered by connection to a hydraulic medium-carrying connection to said hydraulic pressure accumulator or to said hydraulic pump.

22. The pumping station according to claim 21, wherein each of said plurality of combustion engines is connected to a respective one of said hydraulic motors.

23. The pumping station according to claim 1, wherein said combustion engine comprises at least one turbocharger, to which a drive is assigned in order to accelerate said turbocharger on or before a start of said combustion engine.

24. The pumping station according to claim 23, wherein said drive for said turbocharger is a hydraulic motor, which is fed with hydraulic medium from said hydraulic pressure accumulator and/or from a booster pump.

25. The pumping station according to claim 23, wherein said drive for said turbocharger is an electric motor.

26. A pumping station for a pipeline, the pumping station comprising:

at least one feed pump for delivering a fluid through the pipeline;

at least one combustion engine configured for driving said at least the one feed pump;

a hydrostatic system having a first hydraulic motor configured to drive said at least one combustion engine and to accelerate said at least one combustion engine to start-up;

said hydrostatic system having a hydraulic pressure accumulator of limited volume to be filled with a pressurized hydraulic medium, which can be fed to said first hydraulic motor, to thereby power said first hydraulic motor; and wherein a pressure differential in the hydrostatic system prevailing over said first hydraulic motor is variably adjustable, in order to accelerate said combustion engine to a predefined firing speed; and an additional hydraulic motor in said hydrostatic system connected to receive hydraulic medium from said the pressure accumulator, and a hydraulic pump powered by said additional hydraulic motor configured to feed hydraulic medium into said first hydraulic motor.

27. A pumping station for a pipeline, the pumping station comprising:

at least one feed pump for delivering a fluid through the pipeline;

at least one combustion engine configured for driving said at least the one feed pump;

a hydrostatic system having a first hydraulic motor configured to drive said at least one combustion engine and to accelerate said at least one combustion engine to start-up;

said hydrostatic system having a hydraulic pressure accumulator of limited volume to be filled with a pressurized hydraulic medium, which can be fed to said first hydraulic motor, to thereby power said first hydraulic motor; and wherein a pressure differential in the hydrostatic system prevailing over said first hydraulic motor is variably adjustable, in order to accelerate said combustion engine to a predefined firing speed; and at least one booster pump in said hydrostatic system, for feeding hydraulic medium from a hydraulic medium reservoir into said pressure accumulator.

28. A pumping station for a pipeline, the pumping station comprising:

at least one feed pump for delivering a fluid through the pipeline;

at least one combustion engine configured for driving said at least the one feed pump;

a hydrostatic system having a first hydraulic motor configured to drive said at least one combustion engine and to accelerate said at least one combustion engine to start-up;

said hydrostatic system having a hydraulic pressure accumulator of limited volume to be filled with a pressurized hydraulic medium, which can be fed to said first hydraulic motor, to thereby power said first hydraulic motor; and wherein a pressure differential in the hydrostatic system prevailing over said first hydraulic motor is variably adjustable, in order to accelerate said combustion engine to a predefined firing speed; and wherein said combustion engine, said at least one feed pump and said first hydraulic motor are arranged inside an explosion safety zone, and at least one or more or all of the following devices are positioned, spatially separated, outside said explosion safety zone:

said hydraulic pressure accumulator;

at least one booster pump;

said hydraulic medium reservoir;

an additional hydraulic motor;

an adjustable throttle valve;

at least one sensor;

a gas reservoir; and a control device.

* * * * *